US006070311A

United States Patent [19]

Lotz

[11] Patent Number: 6,070,311

[45] Date of Patent: Jun. 6, 2000

[54] DEBURRING INSTALLATION AND TOOLS FOR CONTINUOUS STEEL CASTING PLANT

[75] Inventor: Horst K. Lotz, Hofheim-Wallau, Germany

[73] Assignee: GeGa Corp., Pittsburgh, Pa.

[21] Appl. No.: 08/956,701

[22] Filed: Oct. 24, 1997

[30] Foreign Application Priority Data

Oct. 26, 1996 [EP] European Pat. Off. ..... 96117216

[51] Int. Cl.[7] ..... B23D 17/00; B23D 1/22

[52] U.S. Cl. ..... 29/33 A; 29/81 J; 409/300; 409/301

[58] Field of Search ..... 29/33 A, 81 J, 29/81 D, 81 R; 409/300, 301, 297, 298, 311, 312, 258, 326, 346; 228/13; 164/70.1, 263

[56] References Cited

U.S. PATENT DOCUMENTS

| | | | |
|---|---|---|---|
| 2,521,199 | 9/1950 | Babcock | 148/9 |
| 3,377,896 | 4/1968 | de Corta | 83/3 |
| 3,515,029 | 6/1970 | Gambini | 90/11 |
| 4,357,817 | 11/1982 | Linsinger | 72/71 |
| 4,362,448 | 12/1982 | Hasebe et al. | 409/301 |
| 4,672,726 | 6/1987 | Delbecq et al. | 29/33 A |
| 4,704,241 | 11/1987 | Boggs | 264/161 |
| 5,179,772 | 1/1993 | Braun et al. | 29/81.05 |
| 5,259,440 | 11/1993 | Lotz et al. | 409/297 |
| 5,597,030 | 1/1997 | Lotz et al. | 164/263 |

FOREIGN PATENT DOCUMENTS

| | | | |
|---|---|---|---|
| 21712 | 2/1981 | Japan | 409/301 |
| 71022 | 4/1983 | Japan | 409/301 |
| 3-210951 | 9/1991 | Japan | 164/460 |
| 1389946 | 4/1988 | U.S.S.R. | 409/297 |

*Primary Examiner*—William Briggs
*Attorney, Agent, or Firm*—Alan G. Towner; Eckert Seamans Cherin & Mellott, LLC

[57] ABSTRACT

A deburring apparatus for cutting beards formed at edges of slabs as a result of torch cutting of strands during continuous steel casting operations is disclosed. The apparatus includes extendable pistons having deburring tools mounted thereon. The deburring tools are arranged such that rotation between adjacent tools is substantially prevented. Compressed air containing a lubricant is used to extend the pistons and cool the deburring tools.

6 Claims, 10 Drawing Sheets

DEBURRING INSTALLATION AND TOOLS FOR CONTINUOUS STEEL CASTING PLANT

FIELD OF THE INVENTION

For the deburring of hot and cold slabs which are vertically and horizontally cut on vertically and horizontally cast strands by oxy-technical means, deburring tools as deburring caps and chisels, which are pressed against deburring pistons with compressed-air, are applied which correspond to the characteristics of the respective beards and which protect the deburring pistons against contact with beard parts. The deburring pistons are automatically cooled and lubricated.

BACKGROUND INFORMATION

In the process of mechanization and rationalization in steel and rolling mills, the autogenous torch cutting with heating gas and oxygen, which in contrast to other separating procedures does not only have the undesirable characteristics of loss of material and slag accumulation but especially the formation of only with difficulty removable cutting beards at the separated blooms or slabs, has become extremely important, mainly because of continuous steel casting. Those cutting beards hang on the basic material with a metallic bridge and are mainly rolled while they are still warm during transport over the roller table, fall down in the furnaces used for heating up to rolling temperature and in the worst case still adhere to the work piece during the rolling process. Dirt accumulation and disturbances in different plant parts and unpermitted product depreciations are the consequences.

Besides the known beard removals by hand through scarfing, knocking off, chiselling off, and abrasive cutting there exist corresponding mechanical procedures which mainly—because of the shape of the working pieces, like concave and convex cross sections, diagonal and unregular cuts but also because of beards sizes, material characteristics and cutting equipment—deliver more or less satisfying operation results. One conventional technique illustrated in FIGS. 1*a*–1*c* is the use of a compressed-air cooled, pipe-like body, which is lifted by cylinders 12, and presses a number of deburring pistons 4 with deburring caps, guided out from the pressure room by cylinder bushes 12 against the work piece's lower surfaces for best contact on convex or concave slab surfaces 2. The slab 2 moved by the roller table slides over the deburring caps thus shifting-off the cutting beard. It is also possible that the slab 2 does not move and the deburring installation is moving after the contact of the deburring caps.

DETAILED DESCRIPTION

Figure 1B:
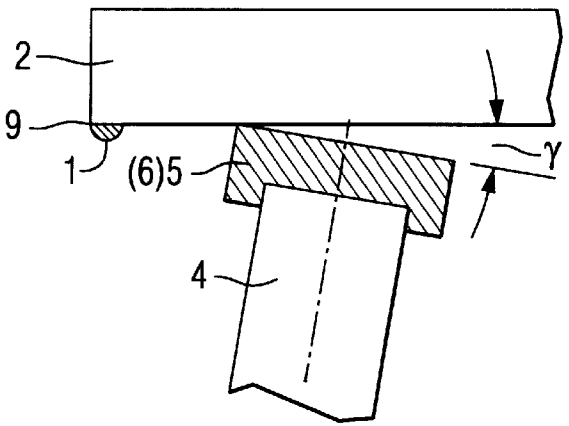
FIGS. 1*a*, 1*b* and 1*c* illustrate a conventional deburring apparatus.
Figure 1C:
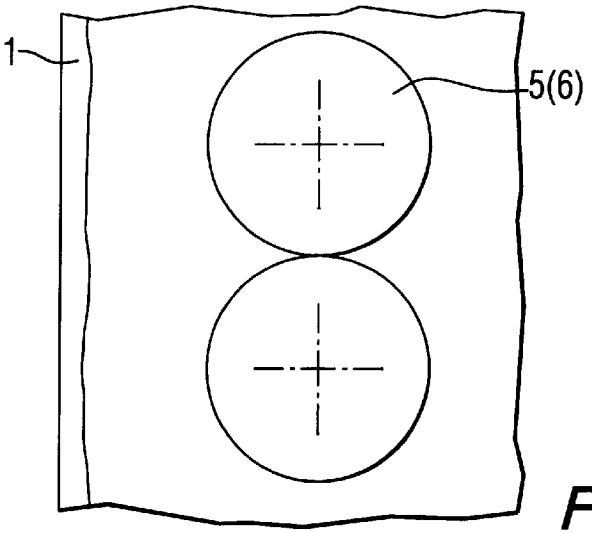
Figure 1A:
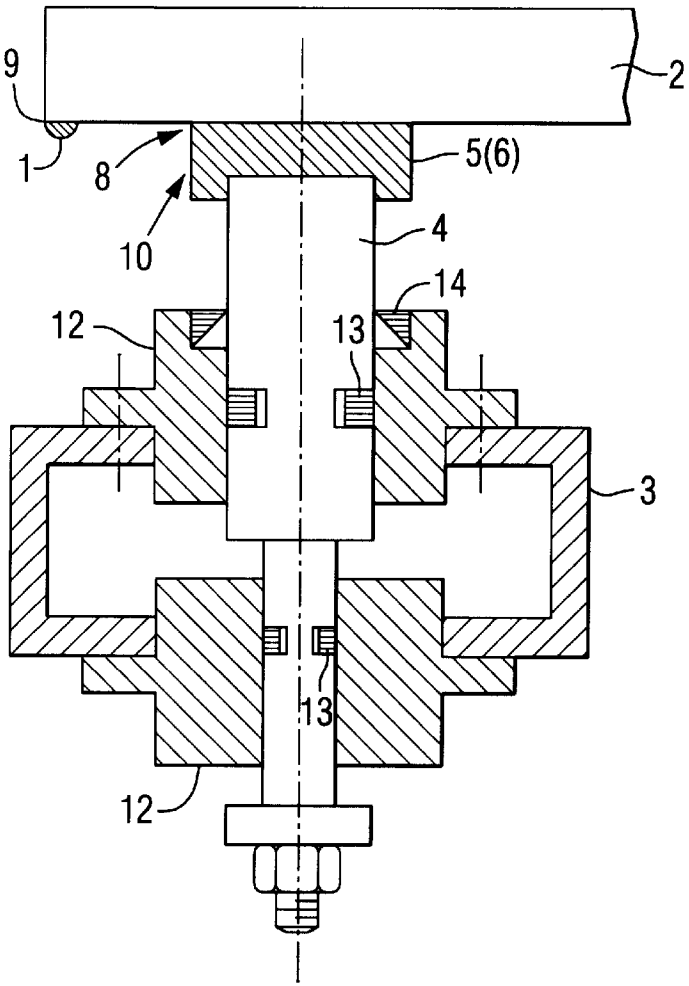

FIG. 1*a* shows the cross section through a compressed-air cooled deburring body 3 with the cylinder bushes 12 which guide the deburring pistons 4 and between which typical sealing rings 13 prevent an undesirable air loss and wiper rings 14 which support the air sealing and prevent the intrusion of dust and dirt. There is also shown the deburring cap 6 with short chip surface 10 near the cutting beard 1 being pressed against the lower surface of a slab 2 with one cutting edge.

FIG. 1*b* in this context shows that the otherwise cylindrically and rectangularly realized deburring cap 6 does press against the slab with a clearance angle $\gamma$ and thus only with a cutting part having as a consequence the reduction of the pressure in the deburring body 3.

The complementary FIG. 1*c* shows a top view of the round deburring caps 6 which advantageously in the beginning do only turn against the cutting beard 1 with the arc-like entering edges for achieving a reduction of the deburring force. Not shown is the deburring body 3 with its deburring caps 6 installed with an as large as possible angle to the cutting beard line 1 so that, because of wear and cost reasons, the required deburring energy results from an as long as possible operation distance in relation to a as small as possible deburring force.

Figure 2B:
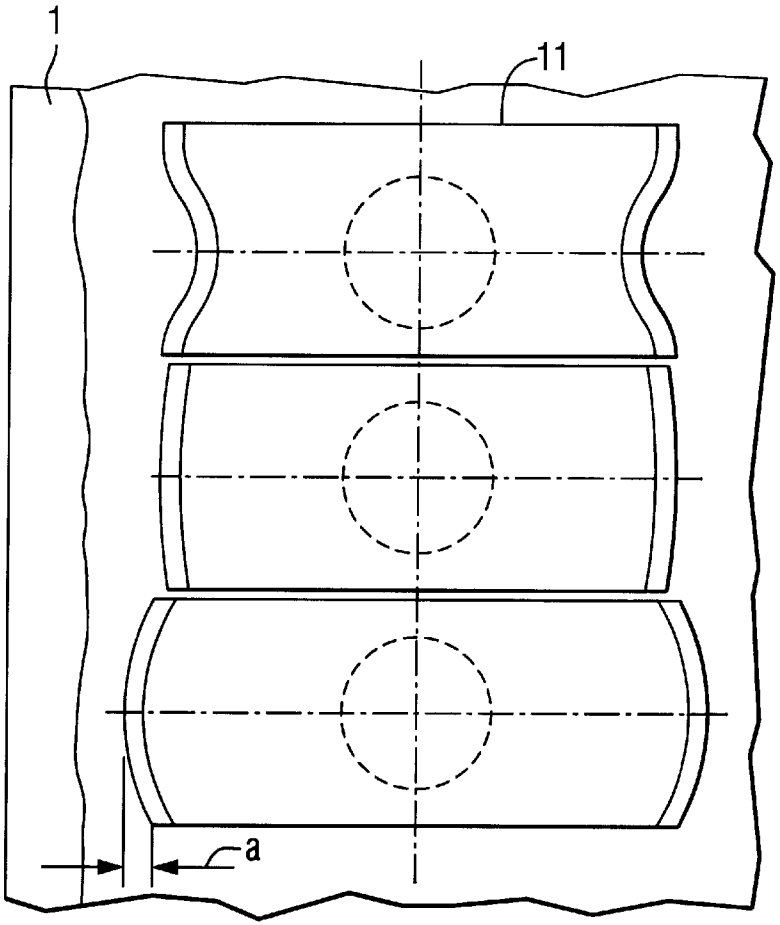
FIGS. 2*a* and 2*b* illustrate a deburring apparatus in accordance with an embodiment of the present invention.
Figure 2A:
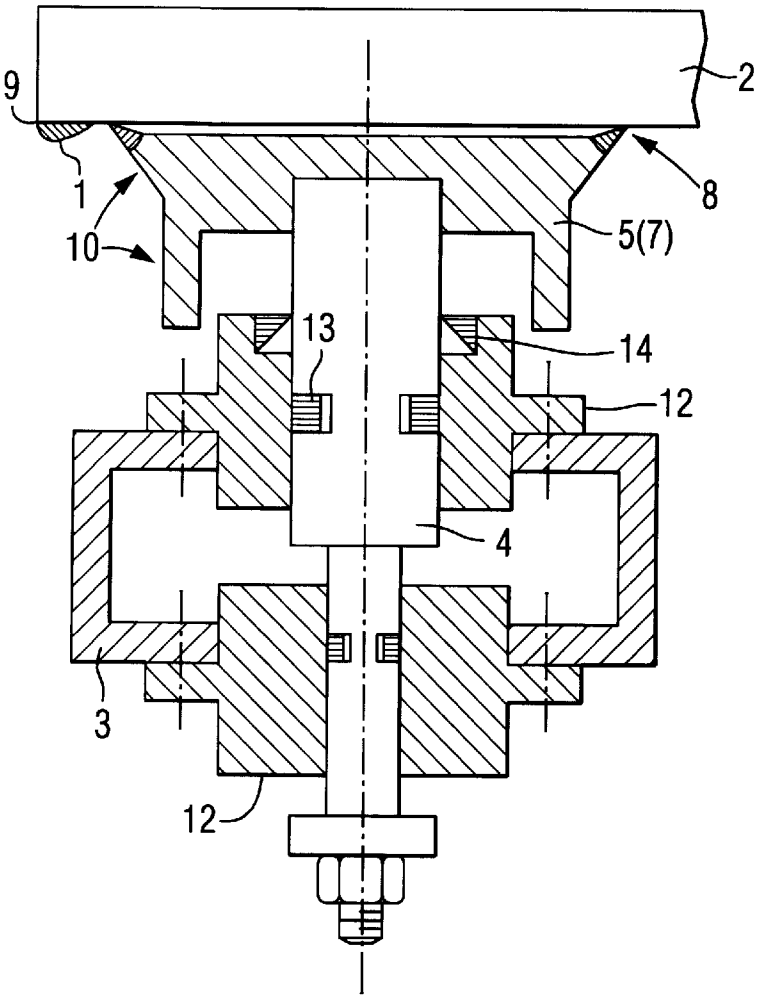

This deburring installation deburrs especially surely and successfully cold cutting beards 1 with a thickness up to 30 mm and a width of up to 30 mm with normal carbon steels. With corresponding but hot material with good, absolutely regular cutting surfaces there can also be expected sure and good deburring results. But with irregular cutting surfaces because of i.e. poorly adjusted and aligned cutting torches during the cutting process of two torches working in opposite directions on one cutting line or because of other cutting stops, it is possible that parts of the cutting beards 1 which have only partly been folded upwards by the deburring caps 6 when sliding over them and which then would normally be knocked-off by the jumping deburring caps 6 behind the slab 2, do only turn upwards and keep hanging on smallest connections in the area of such cutting irregularities. Those cutting beards would fall down in the roller table but additional equipment would be required in order to enable a nearly complete deburring. Because of such cutting irregularities and wider beards out of more adhesive material the deburring caps 6, which were more wear-resistant due to their automatically rotating grinding movement and cost saving by their round and flat shape, have been replaced by a much more expensive and less wear-resistant chisel 7 according to the invention and shown in FIG. 2*a*

The increased wear and costs have to be recompensated by sufficient other advantages. One advantage could be a higher piece number for manufacture in case that also the usual deburring caps 6 could be replaced by the new chisels 7. For this the specific service life of the chisels 7 would have to be increased.

Thus they could at the same time be applied for cold and warm cutting beards 1. This is achieved by making the chisels 7 wear resistant in the area of the cutting blades 8 by welding-on a really expensive but even for higher temperatures sufficiently hard and tough material instead of hardening the deburring cap 6.

A special contradiction concerning the change from round deburring caps 6 to rectangular chisels 7 lies in the required higher deburring force for cold beards in contrast to warm respectively hot separating beards. Up to now, for deburring the round deburring cap 6 as above mentioned was only pressed against the cutting beard 1 with an arc-like part of the entering edge and thus only a part of the whole deburring energy per deburring cap 6 and only a smaller initial deburring force was required. After having deburred the cutting beard 1 with its front cutting blade 8, the rectangular chisel 7 shall jump up with the entire broadside of its back cutting blade 8 as near to the cutting surface of the slab 2 as possible in order to knock-off even smallest rests of the upward folded cutting beard 1. A round front cutting blade 8 similar to the deburring cap 6 and a straight back cutting blade 8 can hardly ever be connected because the front and end cutting beards 1 on a slab 2 have to be removed with one single deburring installation because of economic and space reasons.

Because of the fact that most beards are at least 8 mm thick and 10 mm wide it is possible to change the cutting edge 8 over a deburring distance by rounding or bevelling it in order to reduce the biggest deburring force, provided that the shape of such a cutting edge 8 does not exceed a=5 mm or respectively more corresponding to the thickness of the cutting beard 1 and if possible at a distance of not more than 3 mm width from the cutting surface.

A further problem which does not occur with round deburring caps 6 is the necessity of guidance because of their shape at different height, that is to say more thickness, the rotatable deburring caps 6 cannot come among one another and get jammed. For that reason the rectangular chisels 7 have to be much thicker, with far down-reaching sides 11, also realized as webs, or the deburring pistons 4 have to be equipped with a protection against rotating.

As cutting beards 1 which are formed during torch cutting of hot slabs 2 are often wider than those formed on cold slabs 2, the former require bigger deburring forces. Because of this width of the cutting beards 1 the application of wedge-shaped cutting edges 8 again becomes reasonable. Like the sides 11 the cutting edges 8 can be designed as far down-reaching chip surfaces 10 which protect the deburring pistons 4 against beard chips and scale.

In order to influence the deburring force requirements in a positive way by a wedge-shaped cutting blade 8, this wedge includes a working angle $\Sigma$, composed of chip angle $\alpha$ and wedge angle $\beta$, which should be as small as possible and a smallest clearance angle $\gamma$ which should help to prevent significant friction against the deburring tool.

Figure 3A:
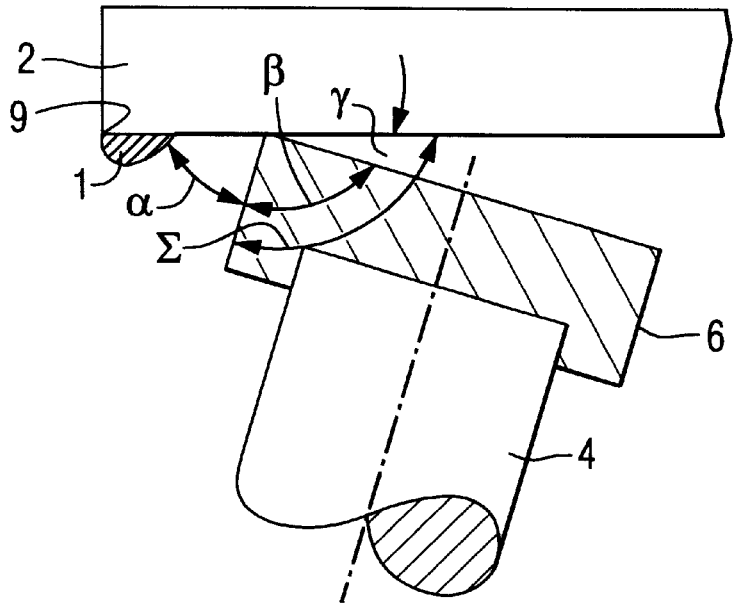
FIG. 3*a* illustrates a conventional deburring tool.

FIG. 3*a* shows the conventional wear-and break-resistant angle relations on a deburring cap 6, wherein $\alpha \leqq 90°$, $\beta=90°$ and a clearance angle $\gamma \geqq 0°$ results in a working angle of $\Sigma \leqq 90°$.

Figure 3B:
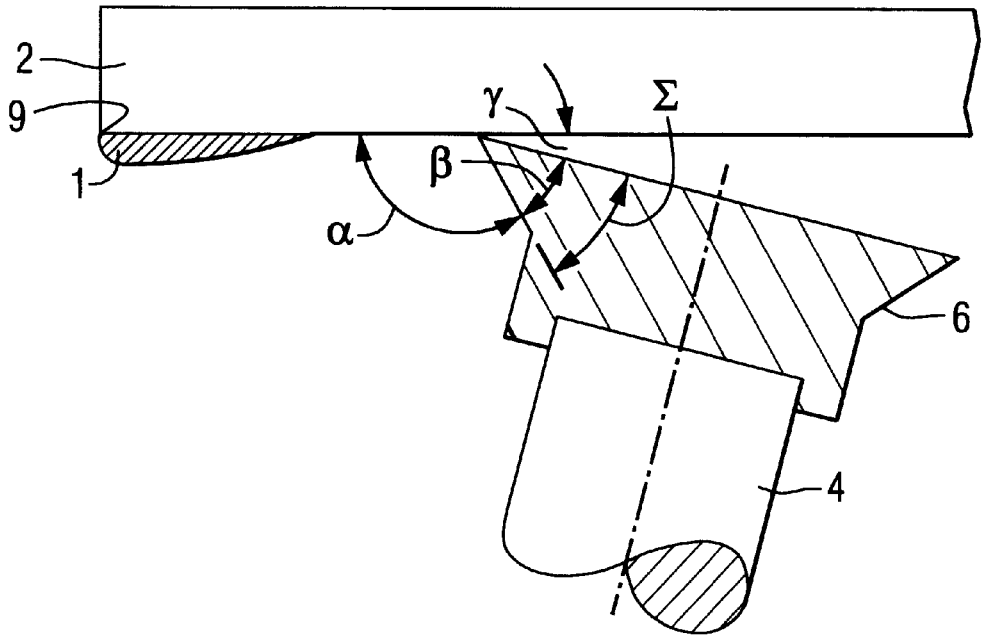
FIG. 3*b* illustrates a deburring tool in accordance with an embodiment of the present invention.
Figure 3C:
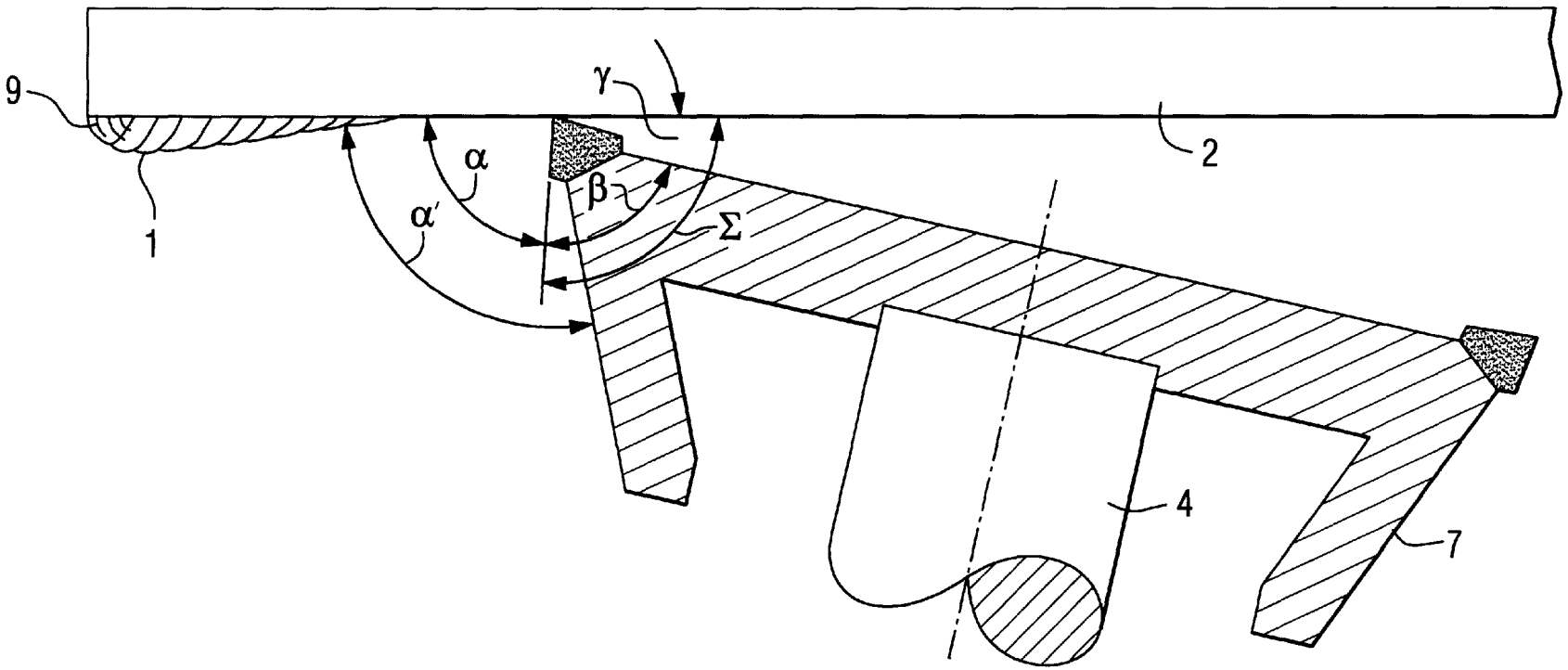
FIG. 3*c* illustrates a deburring tool in accordance with an embodiment of the present invention.

FIG. 3*b* shows the angle relations on a chisel 7. Here the angles amount to $\alpha$ as chip angle 91° to 145°, $\beta$ as wedge angle 30° to 89° and $\gamma$ as clearance angle 0°–5° and result in a working angle $\Sigma$ of 30° to 89°, preferably 40° to 55° according to the hardness of the cutting beard 1 as corresponding tests have shown. Those tests also revealed that there exist favorable force relations when the cutting blade 8 does not hook in the surface of the slab 2. Favorable short chisels 7 do only have those working angles $\Sigma$ near the slab 2, in the following they are guided to the deburring body 3 as a protecting chip surface 10 with a chip angle $\alpha$ increased to 90°.

Figure 4A:
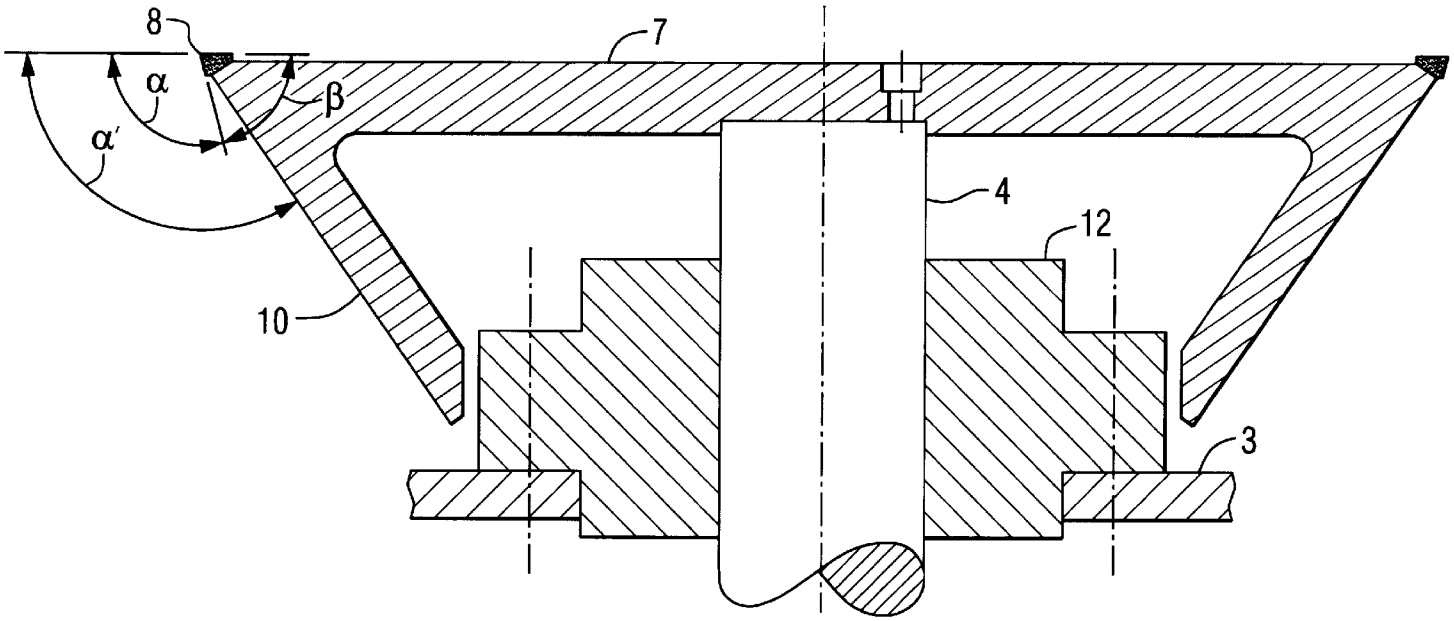
FIGS. 4*a* and 4*b* illustrate a deburring tool in accordance with an embodiment of the present invention.
Figure 4B:
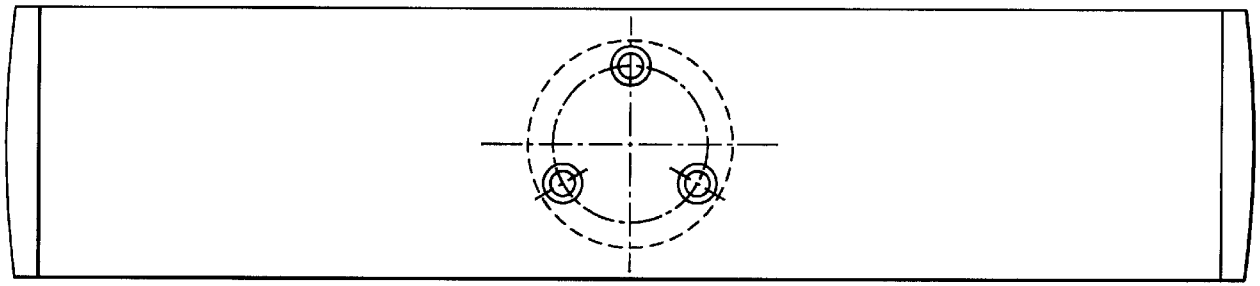

FIGS. 4*a* and 4*b* show a chisel 7 which is especially suitable for very long and hard cutting beards 1 as they arise i.e. on the occasion of horizontal torch cutting of vertically case strands with high steel and low iron oxide percentage. A chip angle $\alpha$, which because of tensile strength reasons begins at the cutting edge 8 with only 120°, soon increases to an angle $\alpha'$ with 135° for the whole thickness of the chisel 7, thus resulting in a better beard deburring. As a consequence the length of the double-edged chisel 7 increases considerably which results in a levering lifting of the long cutting beard 1 and a bending breaking-off of those parts of the cutting beard 1 at its pure metallic bridge 9 to the slab 2.

The sides 11 of the chip surface 10 guiding plate-like front part of the long chisel 7 are sufficient as protection against twisting.

Finally and of greatest importance for the reduction of the deburring forces is the emerging of a lubricant-containing compressed-air in the deburring body 3 alongside the deburring pistons 4. Otherwise this compressed-air is only used for lifting the deburring pistons 4 and for pressing the deburring caps 6 or chisels 7 against the beard-near surface of a slab 2. With sufficient working pressure and supply, a part of this compressed-air can be used for cooling and lubricating the deburring pistons 4 and deburring caps 6 or chisels 7 without any disadvantages.

Figure 5A:
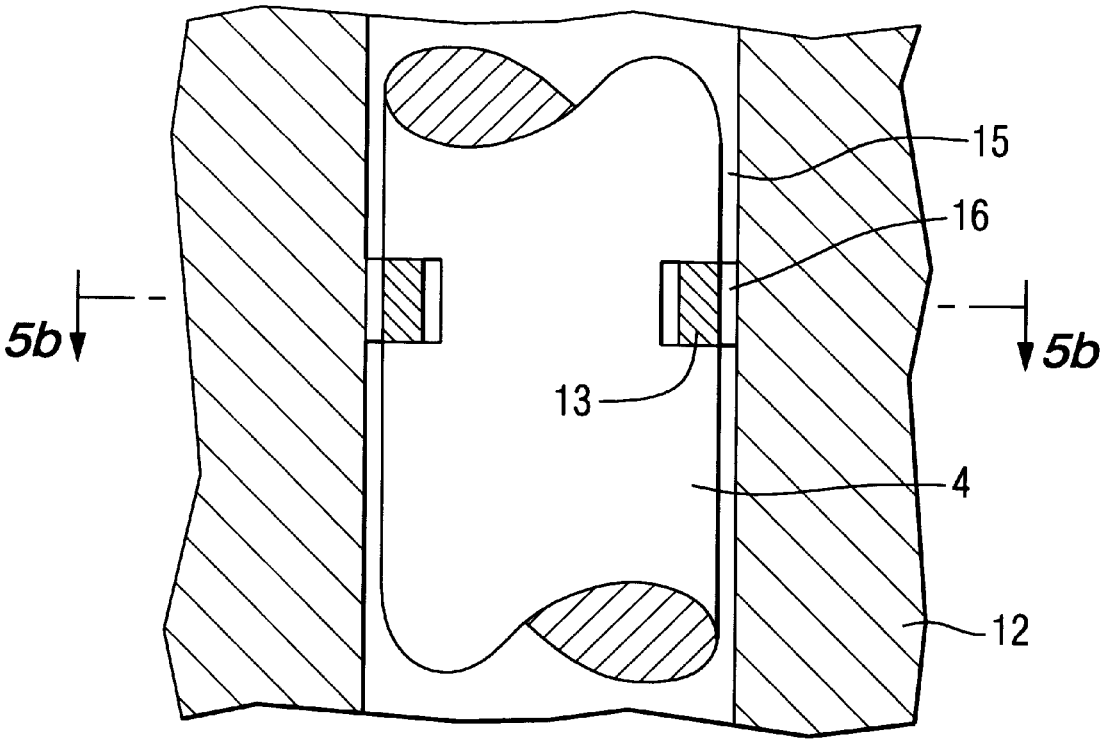
FIGS. 5*a* and 5*b* illustrate a deburring piston in accordance with an embodiment of the present invention.
Figure 5B:
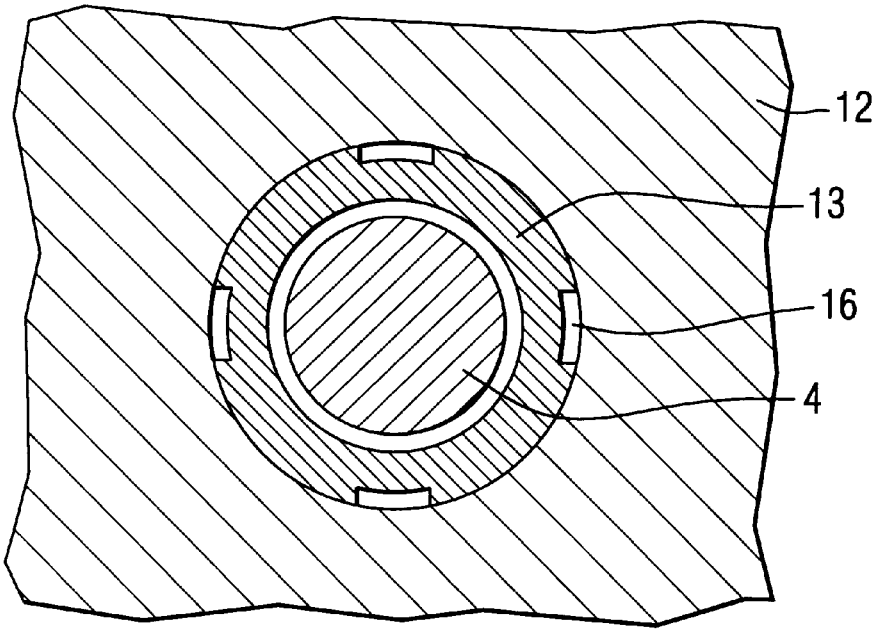

A free moving of the deburring piston 4 enabled by lubrication over its whole length, a tolerance preserving cooling of the latter and of the cylinder bush 12 and a lubrication against friction of the shearing deburring procedure at the deburring tool 5 are enabled by the fact that as shown in FIGS. 5*a* and 5*b* not only the sealing ring 13 but also the wiper ring 14 are sufficiently perforated for the compressed-air emerging. For this the annular clearance 15 existing between deburring piston 4 and cylinder bush 12 has to be around 0.1–0.3 mm, the sealing ring 13 having parallel key-groove-like perforations 16 of 0.5×5 mm on the piston side 6. Thus the compressed-air quantity is controlled.

Figure 6A:
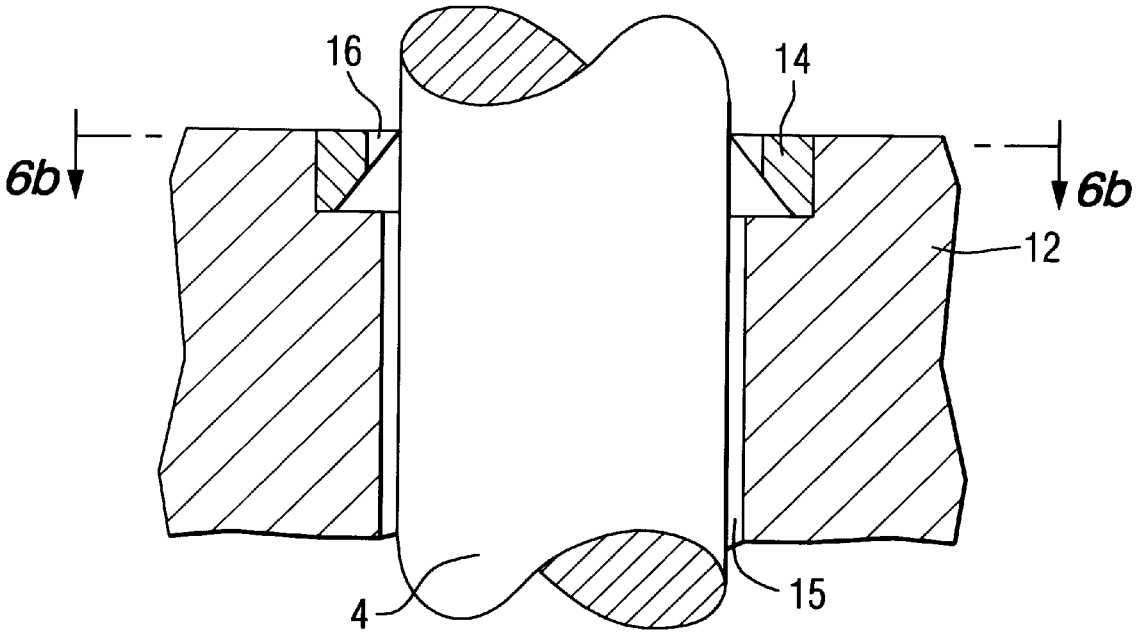
FIGS. 6*a* and 6*b* illustrate a deburring piston in accordance with another embodiment of the present invention.
Figure 6B:
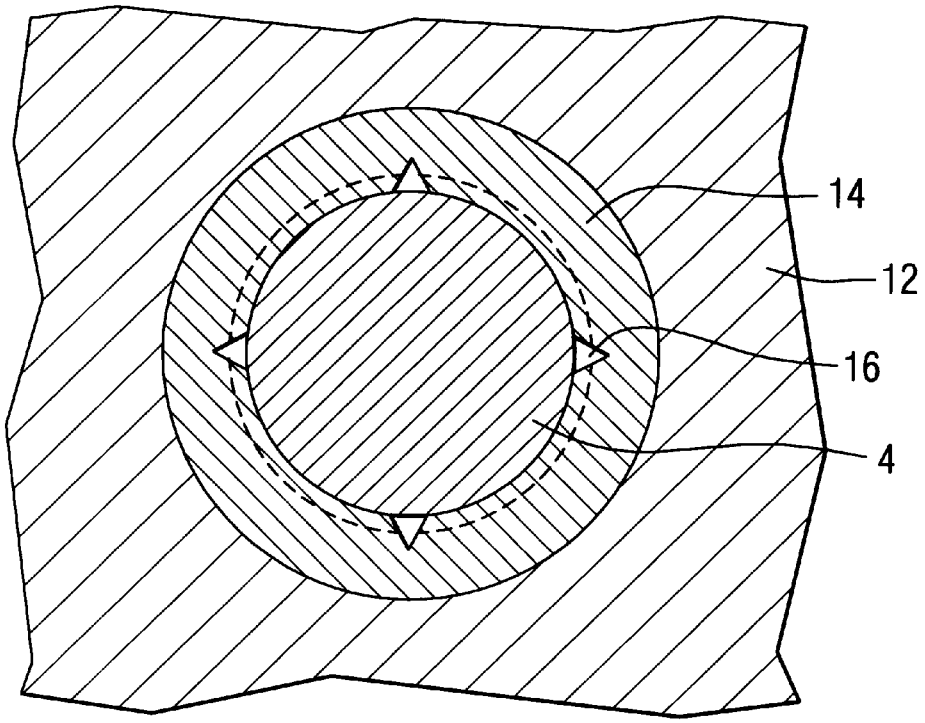

FIGS. 6*a* and 6*b* show the perforations 16 at the wiper ring 14 which are composed out of 4 equilateral triangles with a lateral length of 2.5 mm which are cut in the sealing lip on the piston side and thus have a bigger cross-section than the perforations 16 at the sealing ring 13. All these perforations 16 are designed for a pressure of around 3 bar in the deburring body 3 and for a cross section of 80 mm of the deburring piston 4.

The deburring tools 5 themselves can be perforated by bores or grooves for directing the lubricated air to the friction surfaces.

As further development to the deburring tool design described above, FIGS. 7–9 show deburring tools 5 which are especially advantageous from the product manufacturing point of view.

Figure 7A:
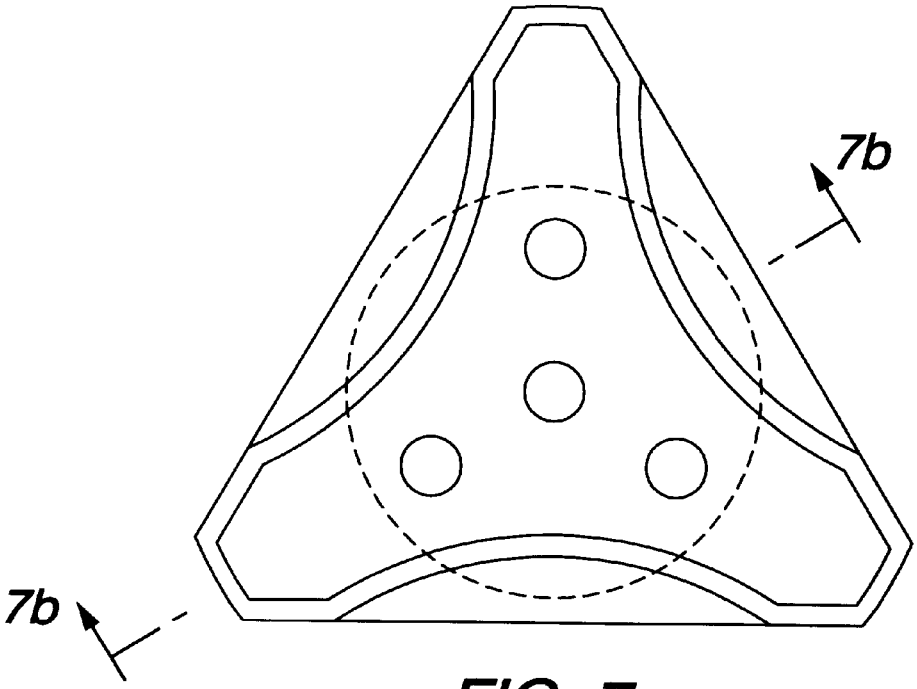
FIGS. 7*a* and 7*b* illustrate a deburring tool in accordance with an embodiment of the present invention.
Figure 7B:
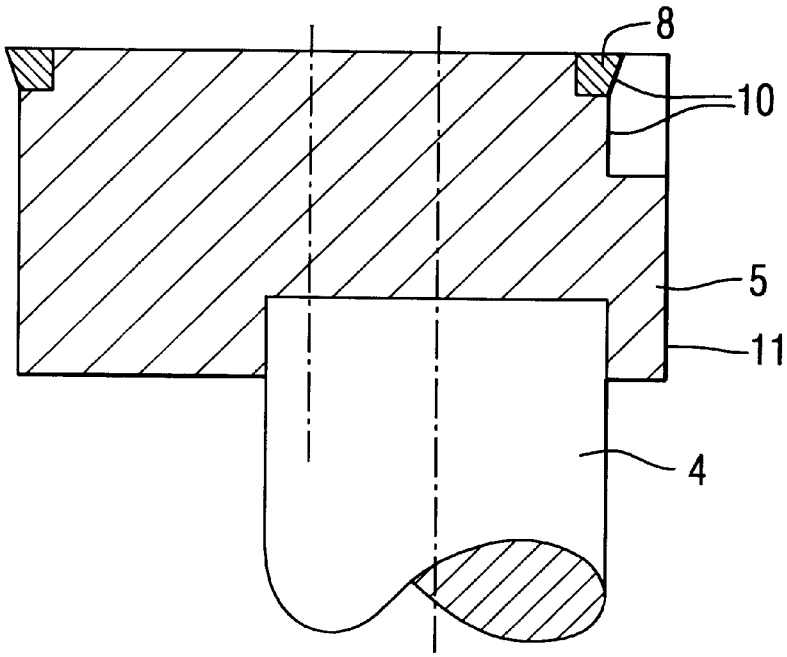
Figure 8:
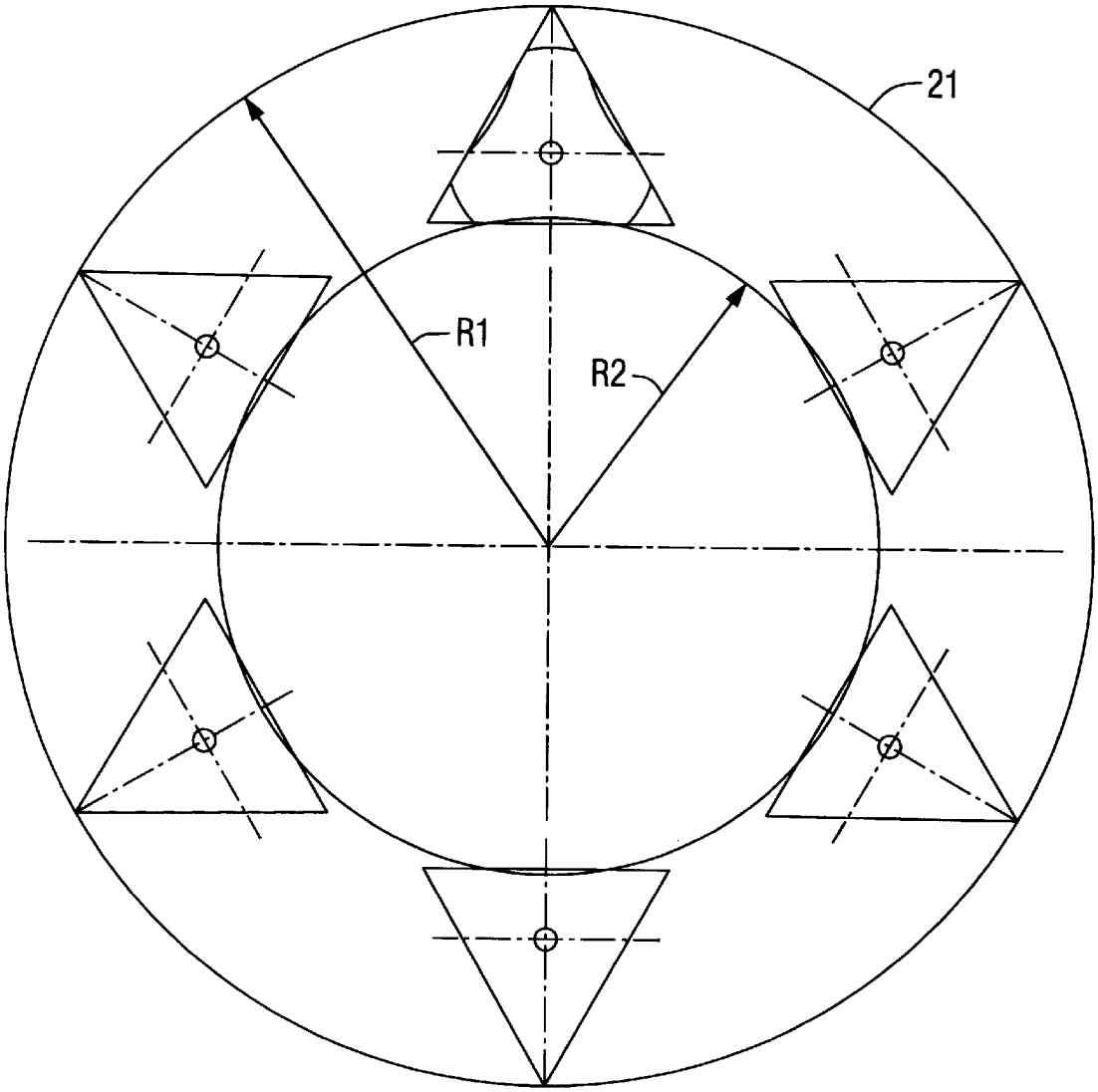
FIG. 8 illustrates multiple deburring tools in accordance with an embodiment of the present invention.

According to FIGS. 7*a* and 7*b* deburring tools 5 are triangular blooms, which are arranged in a circle around a lathe surface plate 21 shown in FIG. 8 and fixed on the deburring piston 4 by the fixing holes of the deburring tools 5. Then the blooms are machined by rotation with $R_1$ on the outside and $R_2$ on the inside in the area of the upper working shape in order to get the working shape, to prepare the welding seam and to trim or remachine after the welding. By removing the triangle by respectively 180° the other sides and vertexes can also be machined.

Figure 9A:
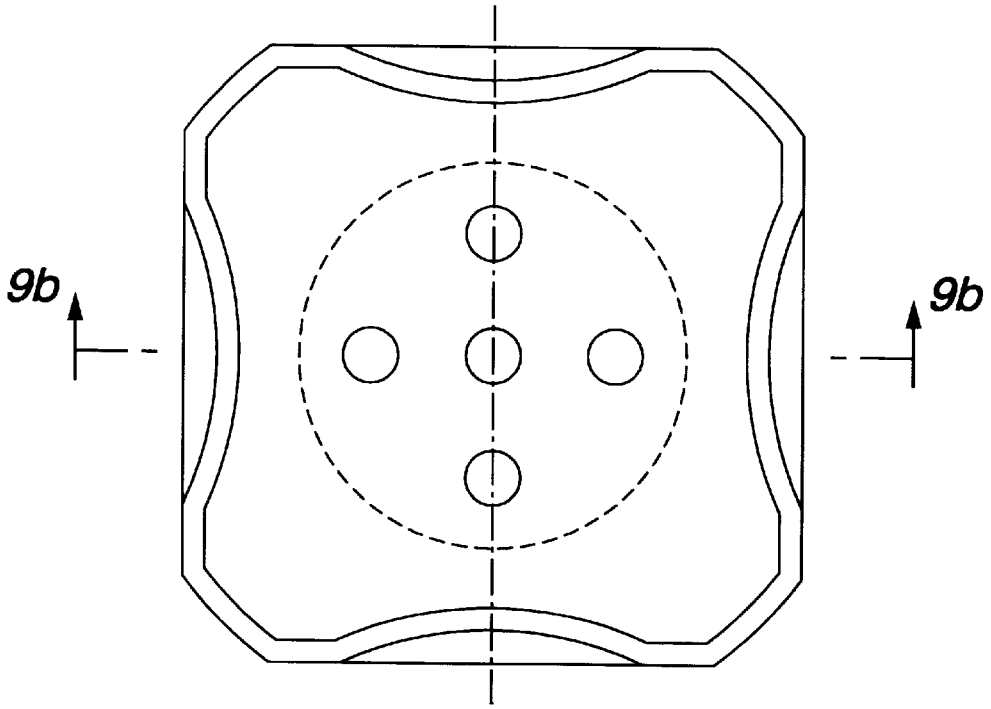
FIGS. 9*a* and 9*b* illustrate a deburring tool in accordance with another embodiment of the present invention.
Figure 9B:
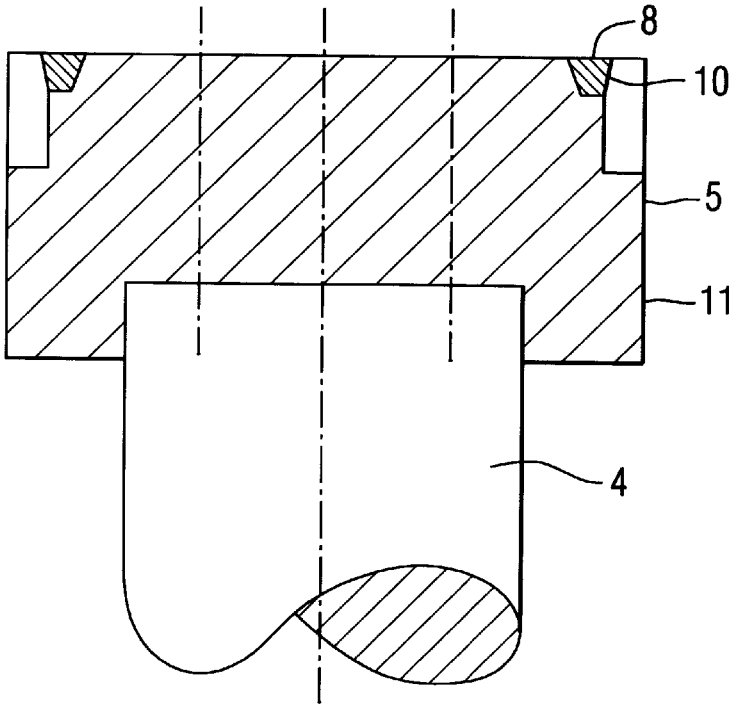

The deburring tools 5 shown in FIGS. 9*a* and 9*b* are square blooms, the machining and function of the therefrom produced deburring tools 5 are similar to those produced out of triangular blooms, but they have advantages and disadvantages with respect to the deburring forces and the wear because of utilization of vertexes and broadsides or of only broadsides.

Whereas particular embodiments of this invention have been described above for purposes of illustration, it will be evident to those skilled in the art that numerous variations of the details of the present invention may be made without departing from the invention as defined in the appended claims.

What is claimed is:

1. A deburring apparatus for cutting beards formed at edges of slabs as a result of torch cutting of strands, comprising:

at least one deburring body;

a plurality of deburring pistons extendable from the at least one deburring body along an extension direction;

a deburring tool mounted on each of the deburring pistons for contacting the slabs, each deburring tool including a plurality of cutting edges on portions thereof, chip surfaces extending from the cutting edges toward the deburring piston, and opposing side walls for substantially preventing rotation of adjacent deburring tools about axes substantially parallel with the extension directions of their respective deburring pistons; and means for cooling the deburring tools.

2. The deburring apparatus of claim 1, wherein the cooling means comprises lubricant-containing compressed air which forces each of the deburring pistons along its extension direction, and at least a portion of the lubricant-containing compressed air is directed along an exterior surface of the deburring piston toward the deburring tool.

3. The deburring apparatus of claim 1, wherein the chip surfaces comprise a chip angle $\alpha$ of from 91° to 145° measured from the slab surface and a wedge angle $\beta$ of from 30° to 89°.

4. The deburring apparatus of claim 1, wherein the chip surfaces extend a sufficient distance to at least partially surround the deburring piston.

5. The deburring apparatus of claim 1, wherein each deburring tool comprises a cross section having a substantially equilateral triangular shape.

6. The deburring apparatus of claim 1, wherein each deburring tool comprises a cross section having a substantially square shape.

* * * * *